United States Patent [19]

Schaper

[11] 4,033,277

[45] July 5, 1977

[54] UNDERHULL QUICK DISCONNECT MOORING SYSTEM

[75] Inventor: Manfred Schaper, Calgary, Canada

[73] Assignee: Canadian Marine Drilling Ltd., Canada

[22] Filed: June 11, 1976

[21] Appl. No.: 694,975

[30] Foreign Application Priority Data

June 11, 1975 Canada ..... 229113

[52] U.S. Cl. ..... 114/230; 9/8 R; 114/293

[51] Int. Cl.[2] ..... B63B 21/00

[58] Field of Search ..... 114/293, 294, 230, 264, 114/265; 9/8 R, 8 P

[56] References Cited

UNITED STATES PATENTS

| | | | |
|---|---|---|---|
| 3,130,703 | 4/1964 | Thompson | 114/206 R |
| 3,799,097 | 3/1974 | Robertson | 114/206 R |
| 3,931,782 | 1/1976 | Childers et al. | 114/206R |
| 3,935,829 | 2/1976 | Lantz | 114/206 R |

*Primary Examiner*—Trygve M. Blix
*Assistant Examiner*—Stuart M. Goldstein
*Attorney, Agent, or Firm*—Lerner, David, Littenberg & Samuel

[57] ABSTRACT

A mooring line or cable system is provided for a drillship including a hull adapted to float in water at a water-line, the mooring line being in the general form of a catenary chain line. The mooring line includes a drillship portion secured to a winch on the drillship and entraining a sheave, and a first spar buoy and an anchor portion including an anchor chain and an anchor and a second spar buoy. A two-part, remote controlled quick disconnect element is provided, one part being connected to the drillship portion and another part being connected to the anchor portion, the two parts being adapted to connect the first spar buoy and the second spar buoy together, to provide an anchored mooring line.

18 Claims, 4 Drawing Figures

UNDERHULL QUICK DISCONNECT MOORING SYSTEM

BACKGROUND OF THE INVENTION i. Field of the Invention

This invention relates to mooring lines and systems and more particularly to an anchoring and mooring system for a drillship.

ii. Description of the Prior Art

The drilling of oil and gas wells in water covered Arctic regions have made it necessary to use a floating vessel called a drillship, usually one containing a vertical opening called a moonpool in the midsection thereof through which drilling operations are conducted. During the drilling operations, it is necessary that the moonpool stay at approximately a fixed position. Thus, to hold a floating drillship in position during drilling operations in marine locations, particularly in the Arctic areas, it has been the practice to use a plurality of mooring lines, each connected at one end to a spaced-apart location on the drillship and at the other end to an anchor. One such system of mooring included eight mooring lines, i.e., two each fore and aft, port and starboard sides. Each of the mooring lines was controlled by a tension winch, and included a length of chain or cable connecting the winch to the anchor.

While such mooring line system is generally satisfactory, there are certain conditions, for example, ice intrusion into the drilling area, where it is desirable and necessary quickly to move the drillship off the drilling location. Relocation of the moonpool of the drillship precisely over the drilling area therefore becomes a problem, since it is necessary to reconnect the mooring lines or cables to the drillship when the drillship is returned to its original location.

One manner of solving such problem which has been suggested involved the use of a spar buoy mooring system allowing a manual but rapid release and a manual reconnect of the mooring line.

SUMMARY OF THE INVENTION i. Aims of the Invention

However, a certain conditions exist where such manual release and manual reconnect of such spar buoy mooring system is not feasible and a more remote system is desirable.

Accordingly, a broad object of this invention is to provide an improved system for rapidly disconnecting a mooring system for a drillship.

Another object of this invention is to provide such an improved system which provides improved safety and more efficient operation time.

Yet another object of this invention is to provide an improved floating vessel including an improved mooring system.

ii. Statements of Invention

This invention broadly provides mooring line system for a vessel including a hull and adapted to float on water at a waterline, comprising: (a) a winch; (b) a sheave associated with the winch; (c) a mooring line or cable secured to the winch, entraining the sheave and secured to a first spar buoy; (d) an anchor chain secured at one end to an anchor and at the other end to a second spar buoy; and (e) a remotely controlled quick disconnect two-part member, one part being secured to the first spar buoy and the other part being secured to the second spar buoy, said two-parts being adapted to connect the first spar buoy and the second spar buoy together, thereby to provide an anchored mooring line or cable.

This invention also provides a vessel which is floating on a body of water at a waterline from which vessel drilling operations may be conducted, the vessel comprising: (A) an elongated hull having a bow, a stern, a deck and a keel, and a well extending vertically through the hull between the deck and the keel and intermediate the bow and the stern; (B) a plurality of winches disposed on the deck about the vessel; and (C) a plurality of mooring line systems in the general form of a catenary chain line, one mooring line system associated with each winch, each mooring line or cable comprising (b) a sheave associated with the winch, (c) a mooring line or cable secured to the winch, entraining the sheave and secured to a first spar buoy, (d) an anchor chain secured at one end to an anchor and at the other end to a second spar buoy, and (e) a remotely controlled quick disconnect two-part member, one part being secured to the first spar buoy and the other part being secured to the second spar buoy, said two-parts being adapted to connect the first spar buoy and the second spar buoy together, thereby to provide an anchored mooring line or cable.

iii. Other Features of the Invention

By another feature of this invention, the remotely controlled quick disconnect two-part member is acoustically controlled.

By still another feature of this invention, a second sheave is included which is secured to the hull of the vessel vertically spaced below the waterline and the first sheave, the second sheave also being entrained by the mooring line.

By another feature the first spar buoy and the second spar buoy each comprise a plurality of substantially, identical hollow tubular members interconnected to provide a substantially cylindrical member of a length/-width ratio substantially greater than one.

By still another feature, in the spar buoy, at least one of the hollow tubular members is provided with flotation meterial.

By a still further feature, each of the hollow tubular members of the spar buoys is provided with foamed-in-situ closed cell plastics foam flotation material.

By yet another feature, the anchor chain is connected to a pendant which in turn is secured to the second spar buoy.

By yet another feature of this invention, eight such mooring line systems are provided, especially where the eight mooring line systems are provided as follows: two at the port aft end of the vessel, two at the starboard aft end of the vessel, two at the port fore end of the vessel and two at the starboard fore end of the vessel.

BRIEF DESCRIPTION OF THE DRAWINGS

In the accompanying drawings.

DESCRIPTION OF PREFERRED EMBODIMENTS i. Description of FIG. 1

Figure 1:
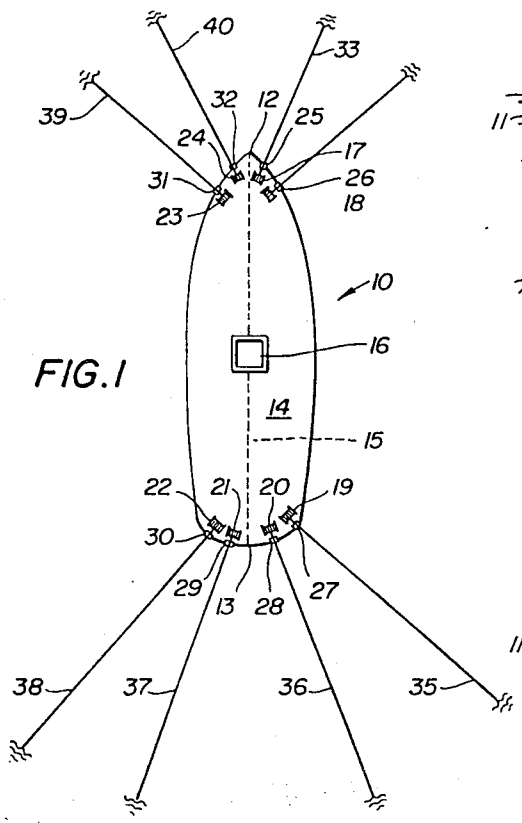
FIG. 1 is a top plan view showing the disposition of a typical eight-line mooring system incorporating one embodiment of this invention.

As seen in FIG. 1, the floating vessel 10 includes a hull 11, a bow 12, a stern 13, a deck 14, and a keel 15 and includes a well 16 extending vertically through the hull 11 from the deck 14 to the keel 15, i.e., the so-called moonpool. A plurality of tension winches 17 – 24 are disposed about the deck 14 and associated with each winch at the deck level is a plurality of fairleads 25 – 32, respectively. Mooring lines or cables 33 – 40 are secured to the tension winches 17 – 24, respectively. It is seen that mooring lines 33 and 34 are disposed at the bow on the starboard side; mooring lines 35 and 36 are disposed at the stern on the starboard side; mooring lines 37 and 38 are disposed at the stern on the port side; and mooring lines 39 and 40 are disposed at the bow on the port side.

ii. Description of FIGS. 2 and 3

Figure 2:
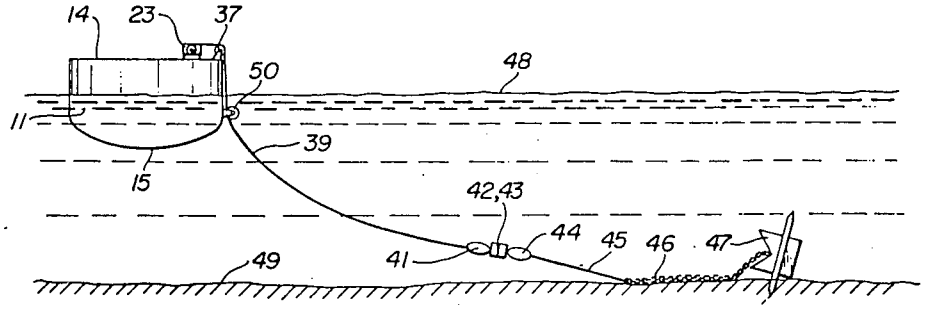
FIG. 2 is a diagrammatic vertical cross-section of one of the eight mooring lines of one embodiment of this invention, in its moored configuration.

Turning now to FIGS. 2 nd 3, the winch 23 includes an upper sheave 37 at the deck thereof and line or cable 39 is secured to the winch 23 and entrains upper sheave 37 to be connected to buoy 41. Buoy 41 is connected to one part 42 of a two-part quick disconnect element 42–43. Thus, the other part 43 is secured to a second buoy 44, which is connected to pendant 45, then to anchor chain 46 which is connected to permanent anchor 47 on the sea floor 49. It is preferred also that a lower sheave 50 be provided so that the system is an under-the-hull dual buoy quick disconnect system.

Figure 3:
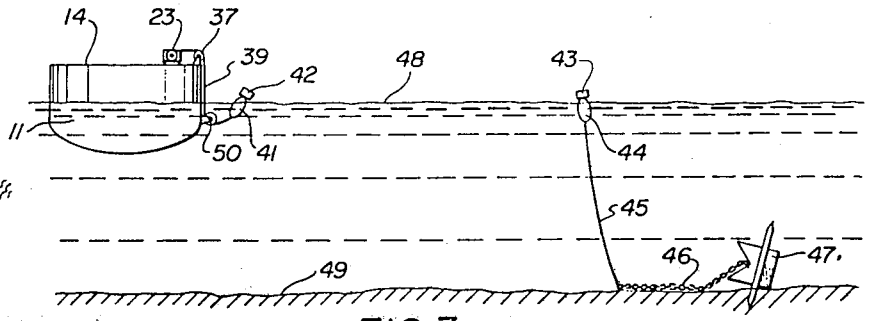
FIG. 3 is a view similar to that of FIG. 2, but in its disconnected mode

In its disconnected mode, as seen in FIG. 3, the quick disconnect element 42–43 has been disconnected. The drillship portion includes the line or cable 39 entrained around sheave 37 and lower sheave 50 and floats to the surface 48 of the water, out of the way of the propellers (not shown) of the drillship 10. The anchored part of the system includes the buoy 44 floating above the water level 48 raising the pendant 45 with it. The chain 46 and permanent anchor 47 remain on the sea floor.

iii. Description of Operative Embodiments

Figure 4:
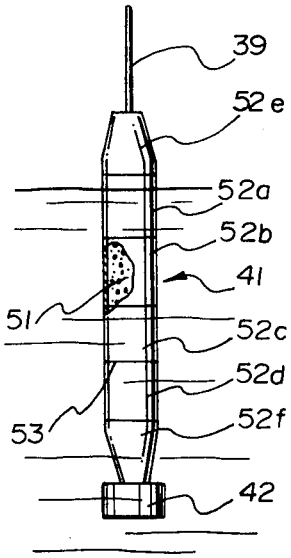
FIG. 4 is a side elevation, partly broken away, of a spar buoy used in this invention.

There are many examples of spar buoys which may be used in this embodiment of this invention. However, as seen in FIG. 4, it has been found that a spar buoy 41, 5 feet in diameter, 40 feet long, ½ inch wall steel plate (filled with conventional flotation material 51 well known in the art to guard against flooding due to damage) will support 300 feet of 2¾ inches chain hanging vertically to the ocean bottom. Suitable such flotation material includes foamed-in-situ closed cell plastics foam material, e.g., polystyrene foam. The buoy may be provided in 10 foot sections 52*a*, 52*b*, 52*c*, 52*d* and two tubular end members 52*e*, 52*f* for interconnection to the cable and the quick disconnect element for ease in handling and for flexibility in water depth (i.e., 600 foot water depth would require an 80 foot long buoy to support 600 feet of 2¾ inches chain).

As noted above, each spar buoy may be formed of a plurality of substantially identical hollow cylindrical segments. The segments of the spar buoy may be assembled in a manner well known in the art. For example, one end may be provided with a threaded end to engage an internally tapped end of an adjacent segment. An epoxy thread-sealing compound may be applied to the threads just before the joint is assembled, and cured in the assembled joint. the joints e.g., 53 between adjacent segments are thus made watertight to seal the interior of the buoy.

The quick disconnect element 42–43 must be remotely controlled and preferably is acoustically controlled. Preferably it is the so-called Rig Anchor Release of Inter Ocean Systems Inc., San Diego, Calif. It consists of a command unit with a service module. The command unit with its transducer is used to send coded signals to the release units. These signals are used to check the status of the release units and to trigger the release when required. The release uses a locking shoe configuration which locks the two sections of the release unit together by engaging two locking rings, one in each section. In the locked position the unit cannot accidentally open. Release is accomplished when the hydraulic accumulators are dumped into the cylinder driving the piston and cam assembly back causing the locking shoes to retract and disengage the locking rings.

OPERATION OF A PREFERRED EMBODIMENT

In one embodiment of this invention, the under-the-hull quick disconnect mooring system consists of one 15-ton anchor, 750 feet of 2¾ inches anchor chain, one 2¼ inches 225 foot pendant, one approximately 8 foot spar buoy (i.e., the anchor spar buoy or second spar buoy), one quick disconnect, one approximately 8 foot spar buoy (i.e., the drillship spar buoy or first spar buoy), plus 3,000 feet of 2¾ inches ship's mooring rope.

If a quick disconnect is required at any time during the drilling operation, the quick disconnect will be opened up by acoustic signal, enabling the system to: (1) disconnect; and (2) float underwater wires to the surfaces to protect the drillship's propellers from being fouled up.

The drillship portion of the system, consisting of one-half of the quick disconnect, approxomately 8 foot spar buoy, plus 2¾ inches mooring wire, will float to the surface. While the drillship portion floats to the surface and is taken in by winches, it is prevented from floating into the propeller by means of the 8 foot spar buoy. The anchored part of the mooring system will float to the surface carrying the 225 foot pendant plus half the disconnect. The parted disconnect can be brought together easily using a supply boat. This can be done in about 2 hours.

SUMMARY

The under-the-hull mooring system of this invention will enable anchor lines to leave the drillship below the water line. This would minimize the effect of ice exerting direct forces on the mooring lines and to avoid spray build-up on the mooring cables. It will also permit ice-breaking workboats to work closer to drillships and be clear of mooring lines.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and intended to be, within the full range of equivalence of the following claims.

I claim:

1. A mooring line system for a vessel including a hull, adapted to float on water at a waterline, said mooring line system being in the general form of a catenary comprising:

a. a winch;

b. a sheave associated with said winch;
c. a mooring line or cable secured to the winch, entraining the sheave and secured to a first spar buoy;
d. an anchor chain secured at one end to an anchor and at the other end to a second spar buoy; and
e. a remotely controlled quick disconnect two-part member, one part being secured to first spar buoy and the other part being secured to said second spar buoy, said two parts being adapted to connect the first spar buoy and the second spar buoy together, thereby to provide an anchored mooring line.

2. The mooring line system of claim 1, wherein the remotely controlled quick disconnect two-part member is acoustically controlled.

3. The mooring line system of claim 1, including a second sheave secured to the hull of said vessel vertically spaced below the waterline and said first sheave, said second sheave being entrained by said mooring line.

4. The mooring line system of claim 1, wherein each of said first spar buoy and said second spar buoy comprises a plurality of substantially, identical hollow tubular members interconnected to provide a substantially cylindrical member of a length/width ratio substantially greater than one.

5. The mooring line system of claim 3, wherein each of said first spar buoy and said second spar buoy comprises a plurality of substantially, identical hollow tubular members interconnected to provide a substantially cylindrical member of a length/width ratio substantially greater than one.

6. The mooring line system of claim 4, wherein at least one of said hollow tubular members of said first spar buoy or said second spar buoy is provided with flotation material.

7. The mooring line system of claim 5, wherein at least one of said hollow tubular members of said first spar buoy or second spar buoy is provided with flotation material.

8. The mooring line system of claim 6, wherein each of said hollow tubular members of said first spar buoy or said second spar buoy is provided with foamed-in-situ closed cell plastics foam flotation material.

9. The mooring line system of claim 7, wherein each of said hollow tubular members of said first spar buoy or said second spar buoy is provided with foamed-in-situ closed cell plastics foam flotation material.

10. The mooring line system of claim 1, wherein said anchor chain is connected to a pendant which in turn is secured to said second spar buoy.

11. The mooring line system of claim 3, wherein said anchor chain is connected to a pendant which in turn is secured to said second spar buoy.

12. A vessel floating on a body of water at a waterline from which vessel drilling operations may be conducted, said vessel comprising:
A. an elongated hull having a bow, a stern, a deck and a keel, and a well extending vertically through the hull between the deck and the keel and intermediate said bow and said stern;
B. a plurality of winches disposed on the deck about the vessel; and
C. a plurality of mooring line systems in the general form of a catenary, one mooring line system being associated with each said winch, each mooring line system comprising
b. a sheave associated with said winch,
c. a mooring line secured to the winch, entraining the sheave and secured to a first spar buoy,
d. an anchor chain secured at one end to an anchor and at the other end to a second spar buoy, and
e. a remotely controlled quick disconnect two-part member, one part being secured to said first spar buoy and the other part being secured to said second spar buoy, said two parts being adapted to connect the first spar buoy and the second spar buoy together, thereby to provide an anchored mooring line.

13. The vessel of claim 12, wherein the anchor chain in said mooring line system is connected to a pendant which in turn is secured to said second spar buoy.

14. The vessel of claim 12, wherein the remotely controlled quick disconnect two-part member in said mooring line system is acoustically controlled.

15. The vessel of claim 12, wherein a second sheave is included in said mooring line system, said second sheave being secured to said hull of said vessel vertically below said waterline and vertically spaced below said first sheave, said second sheave also being entrained by said mooring line.

16. The vessel of claim 12, wherein eight mooring line systems are provided.

17. The vessel of claim 12, wherein eight mooring line systems are provided as follows: two at the port aft end of said vessel, two at the starboard aft end of said vessel, two at the port fore end of said vessel and two at the starboard fore end of said vessel.

18. The vessel of claim 15, wherein eight mooring line systems are provided as follows: two at the port aft end of said vessel, two at the starboard aft end of said vessel, two at the port fore end of said vessel and two at the starboard fore end of said vessel.

* * * * *